US011015141B2

(12) United States Patent
Thiebaut et al.

(10) Patent No.: US 11,015,141 B2
(45) Date of Patent: May 25, 2021

(54) LUBRICANT COMPOSITION BASED ON METAL NANOPARTICLES

(71) Applicant: TOTAL MARKETING SERVICES, Puteaux (FR)

(72) Inventors: Benoit Thiebaut, Lyons (FR); Fabrice Dassenoy, Lyons (FR); Paula Ussa, Lyons (FR)

(73) Assignee: Total Marketing Services, Puteaux (FR)

( * ) Notice: Subject to any disclaimer, the term of this patent is extended or adjusted under 35 U.S.C. 154(b) by 0 days.

(21) Appl. No.: 15/121,987

(22) PCT Filed: Feb. 26, 2015

(86) PCT No.: PCT/EP2015/054099
§ 371 (c)(1),
(2) Date: Aug. 26, 2016

(87) PCT Pub. No.: WO2015/128444
PCT Pub. Date: Sep. 3, 2015

(65) Prior Publication Data

US 2017/0073612 A1 Mar. 16, 2017

(30) Foreign Application Priority Data

Feb. 28, 2014 (FR) ..... 1451648

(51) Int. Cl.

| | |
|---|---|
| ***C10M 125/04*** | (2006.01) |
| ***C01G 39/06*** | (2006.01) |
| ***C10M 171/06*** | (2006.01) |
| ***C10M 141/12*** | (2006.01) |
| *C10N 20/06* | (2006.01) |
| *C10N 30/02* | (2006.01) |
| *C10N 30/06* | (2006.01) |
| *C10N 30/10* | (2006.01) |
| *C10N 30/12* | (2006.01) |
| *C10N 30/00* | (2006.01) |
| *C10N 40/04* | (2006.01) |
| *C10N 50/00* | (2006.01) |

(52) U.S. Cl.

CPC ..... *C10M 171/06* (2013.01); *C10M 141/12* (2013.01); *C10M 2201/065* (2013.01); *C10M 2201/066* (2013.01); *C10M 2203/024* (2013.01); *C10M 2205/0285* (2013.01); *C10M 2223/043* (2013.01); *C10M 2223/045* (2013.01); *C10M 2223/047* (2013.01); *C10N 2020/06* (2013.01); *C10N 2030/02* (2013.01); *C10N 2030/06* (2013.01); *C10N 2030/10* (2013.01); *C10N 2030/12* (2013.01); *C10N 2030/54* (2020.05); *C10N 2040/04* (2013.01); *C10N 2040/044* (2020.05); *C10N 2050/015* (2020.05)

(58) Field of Classification Search

CPC . C10M 125/04; C10M 125/22; C10M 137/10
USPC ..... 508/167, 150
See application file for complete search history.

(56) References Cited

U.S. PATENT DOCUMENTS

| | | | | |
|---|---|---|---|---|
| 4,904,401 | A * | 2/1990 | Ripple | C10M 141/10 508/237 |
| 7,402,800 | B2 | 7/2008 | Delvigne et al. | |
| 7,763,850 | B2 | 7/2010 | Martin | |
| 7,783,407 | B2 | 8/2010 | Dequenne | |
| 8,334,245 | B2 | 12/2012 | Lancon et al. | |
| 9,120,076 | B2 | 9/2015 | Matray et al. | |
| 9,163,137 | B2 | 10/2015 | Bouvy et al. | |
| 9,321,905 | B2 | 4/2016 | Bouvy et al. | |
| 9,334,462 | B2 | 5/2016 | Bouffet et al. | |
| 2005/0119134 | A1 | 6/2005 | Tequi et al. | |
| 2006/0100292 | A1 | 5/2006 | Nolan et al. | |
| 2007/0207934 | A1 | 9/2007 | Ozaki et al. | |
| 2008/0161213 | A1* | 7/2008 | Jao | B82Y 30/00 508/165 |
| 2008/0182927 | A1 | 7/2008 | DiStefano | |
| 2008/0234149 | A1* | 9/2008 | Malshe | C10M 141/10 508/150 |
| 2008/0280793 | A1 | 11/2008 | Tequi et al. | |
| 2009/0203563 | A1 | 8/2009 | Seddon et al. | |
| 2009/0270294 | A1 | 10/2009 | Souchez et al. | |
| 2011/0059877 | A1 | 3/2011 | Obiols et al. | |
| 2011/0092403 | A1 | 4/2011 | Lancon et al. | |
| 2011/0152142 | A1 | 6/2011 | Psaila et al. | |
| 2011/0306527 | A1 | 12/2011 | Bouffet et al. | |
| 2012/0053095 | A1 | 3/2012 | Tequi et al. | |

(Continued)

FOREIGN PATENT DOCUMENTS

| | | |
|---|---|---|
| CN | 101691517 A | 4/2010 |
| EP | 0580019 A1 | 1/1994 |

(Continued)

OTHER PUBLICATIONS

International Search Report and Written Opinion of the ISA for PCT/EP2015/054099, ISA/EP, Rijswijk, NL, dated May 15, 2015.

"Engine Oil Licensing and Certificaton System," American Petroleum Institute, API 1509, Seventeenth Edition, Sep. 2012, 138 pages.

Canter, N.: "Use of antioxidants in automotive lubricants", Tribology & Lubrication Technology, vol. 64, No. 9, Sep. 2008 (Sep. 2008), pp. 12-19, XP002732272.

(Continued)

*Primary Examiner* — Prem C Singh
*Assistant Examiner* — Francis C Campanell
(74) *Attorney, Agent, or Firm* — Harness, Dickey & Pierce, PLC

(57) ABSTRACT

The present disclosure relates to a lubricant composition including an anti-wear additive and metal nanoparticles. The lubricant composition according to the disclosure has, simultaneously, good stability as well as good, long-lasting friction properties.

13 Claims, No Drawings

(56) References Cited

U.S. PATENT DOCUMENTS

| | | | |
|---|---|---|---|
| 2012/0129742 | A1 | 5/2012 | Matray et al. |
| 2012/0165104 | A1 | 6/2012 | Bardin |
| 2012/0172264 | A1 | 7/2012 | Tequi et al. |
| 2013/0096041 | A1 | 4/2013 | Matray et al. |
| 2013/0178402 | A1 | 7/2013 | Chauveau et al. |
| 2013/0244917 | A1 | 9/2013 | Obrecht et al. |
| 2013/0267447 | A1 | 10/2013 | Bardin |
| 2013/0281331 | A1 | 10/2013 | Bardin |
| 2014/0162915 | A1* | 6/2014 | Hatfield ..... C10M 125/22 508/167 |
| 2014/0235516 | A1 | 8/2014 | Lancon |
| 2015/0126419 | A1 | 5/2015 | Lerasle et al. |
| 2015/0218481 | A1 | 8/2015 | Bouffet et al. |
| 2016/0002559 | A1 | 1/2016 | Iovine et al. |
| 2016/0010024 | A1 | 1/2016 | Bouffet et al. |
| 2016/0075965 | A1 | 3/2016 | Bouffet |
| 2016/0130521 | A1 | 5/2016 | Lerasle et al. |
| 2016/0168505 | A1 | 6/2016 | Bouvier et al. |
| 2016/0177216 | A1 | 6/2016 | Lancon et al. |

FOREIGN PATENT DOCUMENTS

| | | | |
|---|---|---|---|
| JP | 2009063154 | A | 3/2009 |
| WO | WO-2011/081538 | A1 | 7/2011 |

OTHER PUBLICATIONS

Tenne, R. et al.; "Polyhedral and cylindrical structures of tungsten disulphide," Nature, vol. 360, Dec. 3, 1992, pp. 444-446.

General document relating to nanoparticles and lubricating composition, Document D2_IP1675735P, ISBN 7-118-03115-1 (2003).

* cited by examiner

LUBRICANT COMPOSITION BASED ON METAL NANOPARTICLES

CROSS-REFERENCE TO RELATED APPLICATIONS

This application is a National Phase Entry of International Patent Application No. PCT/EP2015/054099, filed on Feb. 26, 2015, which claims priority to French Patent Application Serial No. 1451648, filed on Feb. 28, 2014, both of which are incorporated by reference herein.

TECHNICAL FIELD

The present invention is applicable to the field of lubricants, and more particularly to the field of lubricants for motor vehicles. The invention relates to a lubricant composition comprising metal nanoparticles. More particularly, the invention relates to a lubricant composition comprising an anti-wear additive and metal nanoparticles. The lubricant composition according to the invention simultaneously has good stability as well as good, long-lasting friction properties.

The present invention also relates to a process for the lubrication of a mechanical part utilizing this lubricant composition. The present invention also relates to a composition of the additive-concentrate type comprising an anti-wear additive and metal nanoparticles.

BACKGROUND

Motor vehicle transmission components operate under a high load and high speeds. The oils for these transmission components must therefore be particularly efficient at protecting parts against wear, and in particular must have good properties for reducing friction on the surface of the components. Thus, if the friction level is not adapted to the geometry of the parts, wear occurs on the cone-ring assembly. The friction level can be adjusted by adding friction modifiers to these oils for gear boxes.

Moreover, the general introduction of motor vehicles on a global scale since the end of the last century poses problems relating to global warming, pollution, safety and use of natural resources, in particular the depletion of petroleum reserves. Following establishment of the Kyoto protocol, new standards protecting the environment require the car industry to construct vehicles having reduced pollutant emissions and fuel consumption. As a result, the engines of these vehicles are subject to increasingly stringent technical constraints: in particular they run more quickly, at increasingly high temperatures, and are required to consume less and less fuel.

The nature of engine lubricants for automobiles has an influence on the emission of pollutants and on fuel consumption. Engine lubricants for automobiles, called energy-saving or "fuel-eco", have been developed in order to meet these new requirements.

Improvement in the energy performance of lubricant compositions can be obtained in particular by mixing friction modifiers into base oils. Among the friction modifiers, organometallic compounds comprising molybdenum are commonly used. In order to obtain good friction reduction properties, a sufficient quantity of molybdenum must be present in the lubricant composition.

However, these compounds have the drawback of causing the formation of sediments when the lubricant composition has too high a content of elemental molybdenum. The poor solubility of these compounds modifies, or even degrades the properties of the lubricant composition, in particular its viscosity. Now, a composition which is too viscous or not viscous enough militates against the movement of the mobile parts, easy starting of an engine, the protection of an engine when it has reached its operating temperature, and therefore ultimately causes in particular an increase in fuel consumption.

Moreover, these compounds contribute to an increase in the level of ash, reducing their potential for use in a lubricant composition, in particular in Europe. It is also known to formulate lubricant compositions comprising friction modifier compounds of the organomolybdenum type with organophosphorus- and/or organosulphur- and/or organophosphorus/sulphur-containing anti-wear and extreme-pressure compounds, in particular in order to improve the anti-wear properties of these engine or transmission oils.

Other compounds for reducing friction have been described as possibly being useful in the lubrication of mechanical parts, in particular of the parts of an engine. Document CN 101691517 describes an engine oil comprising tungsten disulphide nanoparticles, making it possible to improve the service life of the engine and reduce fuel consumption. However, the content of tungsten disulphide nanoparticles ranges from 15 to 34%, which can lead to risks of instability of the oil over time.

Moreover, the combination of nanoparticles and anti-wear compounds in grease compositions has been described, for example in document WO 2007/085643. However, this document only describes grease compositions and does not describe any engine or transmission lubricant.

It would therefore be desirable to have available a lubricant composition, in particular for motor vehicles, which is not a grease and which is both stable and has good friction reduction properties. It would also be desirable to have available a lubricant composition, in particular for motor vehicles, which is not a grease and the performances of which last over time. It would also be desirable to have available a lubricant composition, in particular for motor vehicles, which is not a grease and has good friction reduction properties while retaining satisfactory anti-flaking properties.

An objective of the present invention is to provide a lubricant composition overcoming some or all of the aforementioned drawbacks. Another objective of the invention is to provide a lubricant composition that is stable and easy to utilize. Another objective of the present invention is to provide a lubrication process making it possible in particular to reduce friction on the surface of mechanical parts, and more particularly of an engine or of a transmission component of motor vehicles.

SUMMARY

The invention thus relates to a lubricant composition with kinematic viscosity at 100° C., measured according to standard ASTM D445, ranging from 4 to 50 cSt and comprising at least one base oil, at least one compound comprising a dithiophosphate group and metal nanoparticles at a content by weight ranging from 0.01 to 2% with respect to the total weight of the lubricant composition. Surprisingly, the applicant found that the presence of a compound comprising a dithiophosphate group in a lubricant composition comprising at least one base oil and metal nanoparticles makes it possible to give said composition very good friction reduction properties. Moreover, the applicant found that the combination of a compound comprising a dithiophosphate group and metal nanoparticles in a lubricant composition makes it possible to maintain this reduction of friction over time. Without being bound by a particular theory, this maintenance of the effectiveness of friction reduction over time might be explained by the protection against oxidation of the metal nanoparticles by the compound comprising a dithiophosphate group, thus prolonging the action of the metal nanoparticles on the surface of a mechanical part, and more particularly of a transmission component or of a motor vehicle engine. Thus, the present invention makes it possible to formulate stable lubricant compositions comprising a reduced content of metal nanoparticles and having, however, remarkable friction reduction properties.

Advantageously, the lubricant compositions according to the invention have remarkable friction reduction properties that are maintained over time. Advantageously, the lubricant compositions according to the invention have good stability as well as viscosity that does not vary, or only very slightly. Advantageously, the lubricant compositions according to the invention have satisfactory anti-flaking properties. Advantageously, the lubricant compositions according to the invention have a reduced risk of oxidation. Advantageously, the lubricant compositions according to the invention have remarkable fuel saving properties.

In an embodiment, the lubricant composition essentially consists of at least one base oil, at least one compound comprising a dithiophosphate group and at least metal nanoparticles at a content by weight ranging from 0.01 to 2% with respect to the total weight of the lubricant composition. The invention also relates to an engine oil comprising a lubricant composition as defined above. The invention also relates to a transmission oil comprising a lubricant composition as defined above.

The invention also relates to the use of a lubricant composition as defined above for the lubrication of a mechanical part, preferably of a transmission component or of a vehicle engine, advantageously of motor vehicles. The invention also relates to the use of a lubricant composition as defined above for reducing friction on the surface of a mechanical part, preferably of a transmission component or of a vehicle engine, advantageously of motor vehicles. The invention also relates to the use of a lubricant composition as defined above for reducing the fuel consumption of vehicles, in particular of motor vehicles.

The invention also relates to a process for the lubrication of a mechanical part, preferably of a transmission component or of a vehicle engine, advantageously of motor vehicles, said process comprising at least one step of bringing the mechanical part into contact with a lubricant composition as defined above. The invention also relates to a process for reducing the friction on the surface of a mechanical part, preferably of a transmission component or of a vehicle engine, advantageously of motor vehicles, comprising at least bringing the mechanical part into contact with a lubricant composition as defined above. The invention also relates to a process for reducing the fuel consumption of a vehicle, in particular of a motor vehicle, comprising at least one step of bringing a mechanical part of the vehicle engine into contact with a lubricant composition as defined above. The invention also relates to the use of a compound comprising a dithiophosphate group for decreasing the oxidation of a lubricant composition comprising at least one base oil and metal nanoparticles. The invention also relates to a composition of the additive-concentrate type comprising at least one compound comprising a dithiophosphate group and tungsten disulphide nanoparticles.

DETAILED DESCRIPTION

The percentages given below correspond to percentages by mass of active ingredient.

Metal Nanoparticles

The lubricant composition according to the invention comprises metal nanoparticles at a content by weight ranging from 0.01 to 2% with respect to the total weight of the lubricant composition. By "metal nanoparticles", is meant in particular metal particles, generally solid, the average size of which is less than or equal to 600 nm.

Advantageously, the metal nanoparticles are constituted by at least 80% by mass of at least one metal, or by at least 80% by mass of at least one metal alloy or by at least 80% by mass of at least one metal, in particular transition metal, chalcogenide with respect to the total mass of the nanoparticle. Advantageously, the metal nanoparticles are constituted by at least 90% by mass of at least one metal, or by at least 90% by mass of at least one metal alloy or by at least 90% by mass of at least one metal, in particular transition metal, chalcogenide with respect to the total mass of the nanoparticle. Advantageously, the metal nanoparticles are constituted by at least 99% by mass of at least one metal, or by at least 99% by mass of at least one metal alloy or by at least 99% by mass of at least one metal, in particular transition metal, chalcogenide with respect to the total mass of the nanoparticle, the remaining 1% being constituted by impurities.

Advantageously, the metal of which the metal nanoparticle is constituted can be selected from the group constituted by tungsten, molybdenum, zirconium, hafnium, platinum, rhenium, titanium, tantalum, niobium, cerium, indium and tin, preferably molybdenum or tungsten, advantageously tungsten. The metal nanoparticles can have the form of spheres, lamellas, fibres, tubes, and fullerene-type structures. Advantageously, the metal nanoparticles used in the compositions according to the invention are solid metal nanoparticles having a fullerene-type (or fullerene-like) structure and are represented by the formula $MX_n$ in which M represents a transition metal, X a chalcogen, with n=2 or n=3 depending on the oxidation state of the transition metal M.

Preferably, M is selected from the group constituted by tungsten, molybdenum, zirconium, hafnium, platinum, rhenium, titanium, tantalum and niobium. More preferably, M is selected from the group constituted by molybdenum and tungsten. Even more preferably, M is tungsten.

Preferably, X is selected from the group constituted by oxygen, sulphur, selenium and tellurium. Preferably, X is selected from sulphur or tellurium. Even more preferably, X is sulphur.

Advantageously, the metal nanoparticles according to the invention are selected from the group constituted by $MoS_2$, $MoSe_2$, $MoTe_2$, $WS_2$, $WSe_2$, $ZrS_2$, $ZrSe_2$, $HfS_2$, $HfSe_2$, $PtS_2$, $ReS_2$, $ReSe_2$, $TiS_3$, $ZrS_3$, $ZrSe_3$, $HfS_3$, $HfSe_3$, $TiS_2$, $TaS_2$, $TaSe_2$, $NbS_2$, $NbSe_2$ and $NbTe_2$. Preferably, the metal nanoparticles according to the invention are selected from the group constituted by $WS_2$, $WSe_2$, $MoS_2$ and $MoSe_2$, preferentially $WS_2$ and $MoS_2$, preferentially $WS_2$. The nanoparticles according to the invention advantageously have a fullerene-type structure.

Initially, the term fullerene denotes a closed convex polyhedron nanostructure, composed of carbon atoms. The fullerenes are similar to graphite, composed of sheets of linked hexagonal rings, but they contain pentagonal, and sometimes heptagonal rings, which prevent the structure from being flat.

Studies of the fullerene-type structures have shown that this structure was not limited to the carbon-containing materials, but was capable of being produced in all the nanoparticles of materials in the form of sheets, in particular in the case of the nanoparticles comprising chalcogens and transition metals. These structures are analogous to that of the carbon fullerenes and are called inorganic fullerenes or fullerene-type structures (or "Inorganic Fullerene-like materials", also denoted "IF"). The fullerene-type structures are described in particular by Tenne, R., Margulis, L., Genut M. Hodes, G. *Nature* 1992, 360, 444. The document EP 0580 019 describes in particular these structures and their synthesis process.

In a preferred embodiment of the invention, the metal nanoparticles are closed structures, of the spherical type, more or less perfect depending on the synthesis processes used. The nanoparticles according to the invention are concentric polyhedrons with a multilayer or sheet structure. This is referred to as an "onion" or "nested polyhedron" structure. In an embodiment of the invention, the metal nanoparticles are multilayer metal nanoparticles comprising from 2 to 500 layers, preferably from 20 to 200 layers, advantageously from 20 to 100 layers.

The average size of the metal nanoparticles according to the invention ranges from 5 to 600 nm, preferably from 20 to 400 nm, advantageously from 50 to 200 nm. The size of the metal nanoparticles according to the invention can be determined using images obtained by transmission electron microscopy or by high resolution transmission electron microscopy. It is possible to determine the average size of the particles from measurement of the size of at least 50 solid particles visualized on transmission electron microscopy photographs. The measured median value of the distribution histogram of the sizes of the solid particles is the average size of the solid particles used in the lubricant composition according to the invention.

In an embodiment of the invention, the average diameter of the primary metal nanoparticles according to the invention ranges from 10 to 100 nm, preferably from 30 to 70 nm. Advantageously, the content by weight of metal nanoparticles ranges from 0.05 to 2%, preferably from 0.1 to 1%, advantageously from 0.1 to 0.5% with respect to the total weight of the lubricant composition. As an example of metal nanoparticles according to the invention, the product NanoLub Gear Oil Concentrate marketed by the company Nanomaterials may be mentioned, being presented in the form of a dispersion of multilayer nanoparticles of tungsten disulphide in a mineral oil or oil of the PAO (Poly Alfa Olefin) type.

Compound Comprising a Dithiophosphate Group

The lubricant composition according to the invention comprises at least one compound comprising a dithiophosphate group. With a view to simplification of the description, the compound comprising a dithiophosphate group is called "dithiophosphate" in the remainder of the present description. The dithiophosphate, without being limitative, can be selected from the ammonium dithiophosphates, the amine dithiophosphates, the ester dithiophosphates and the metal dithiophosphates, alone or in a mixture.

In an embodiment of the invention, the dithiophosphate is selected from the ammonium dithiophosphates of formula (I):

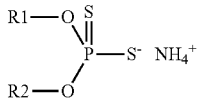

(I)

in which R1 and R2 represent, independently of one another, a hydrocarbon-containing group, optionally substituted, comprising from 1 to 30 carbon atoms.

In a preferred embodiment of the invention, R1 and R2 represent, independently of one another, a hydrocarbon-containing group, optionally substituted, comprising from 2 to 24 carbon atoms, more preferentially from 3 to 18 carbon atoms, advantageously from 5 to 12 carbon atoms. In another preferred embodiment of the invention, R1 and R2 represent, independently of one another, an unsubstituted hydrocarbon-containing group, and said hydrocarbon-containing group can be an alkyl, alkenyl, alkynyl, phenyl or benzyl group. In another preferred embodiment of the invention, R1 and R2 represent, independently of one another, a linear or branched alkyl hydrocarbon-containing group, more preferentially a linear alkyl hydrocarbon-containing group. In another preferred embodiment of the invention, R1 and R2 represent, independently of one another, a hydrocarbon-containing group optionally substituted by at least one oxygen, nitrogen, sulphur and/or phosphorus atom, preferably by at least one oxygen atom. As examples of ammonium dithiophosphate, the ammonium dimethyldithiophosphates, the ammonium diethyldithiophosphates and the ammonium dibutyldithiophosphates can be mentioned.

In another embodiment of the invention, the dithiophosphate is selected from the amine dithiophosphates of general formula (II):

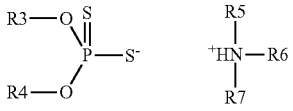

(II)

in which:

R3 and R4 represent, independently of one another, a hydrocarbon-containing group, optionally substituted, comprising from 1 to 30 carbon atoms, R5, R6 and R7 represent, independently of one another, a hydrogen atom or a hydrocarbon-containing group with 1 to 30 carbon atoms, it being understood that at least one of the R5, R6 and R7 groups does not represent a hydrogen atom.

In a preferred embodiment of the invention, R3 and R4 represent, independently of one another, a hydrocarbon-containing group, optionally substituted, comprising from 2 to 24 carbon atoms, more preferentially from 3 to 18 carbon atoms, advantageously from 5 to 12 carbon atoms. In another preferred embodiment of the invention, R3 and R4 represent, independently of one another, an unsubstituted hydrocarbon-containing group, and said hydrocarbon-containing group can be an alkyl, alkenyl, alkynyl, phenyl or benzyl group. In another preferred embodiment of the invention, R3 and R4 represent, independently of one another, a linear or branched alkyl hydrocarbon-containing group, more preferentially a linear alkyl hydrocarbon-containing group. In another preferred embodiment of the invention, R3 and R4 represent, independently of one another, a hydrocarbon-containing group optionally substituted by at least one oxygen, nitrogen, sulphur and/or phosphorus atom, preferably by at least one oxygen atom. In another preferred embodiment of the invention, R5, R6 and R7 represent, independently of one another, a hydrocarbon-containing group comprising from 2 to 24 carbon atoms, more preferentially from 3 to 18 carbon atoms, advantageously from 5 to 12 carbon atoms.

In another embodiment of the invention, the dithiophosphate is selected from the ester dithiophosphates of general formula (III):

(III)

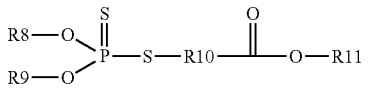

in which:

R8 and R9 represent, independently of one another, a hydrocarbon-containing group, optionally substituted, comprising from 1 to 30 carbon atoms, R10 and R11 represent, independently of one another, a hydrocarbon-containing group comprising from 1 to 18 carbon atoms.

In a preferred embodiment of the invention, R8 and R9 represent, independently of one another, a hydrocarbon-containing group, optionally substituted, comprising from 2 to 24 carbon atoms, more preferentially from 3 to 18 carbon atoms, advantageously from 5 to 12 carbon atoms. In another preferred embodiment of the invention, R8 and R9 represent, independently of one another, an unsubstituted hydrocarbon-containing group, and said hydrocarbon-containing group can be an alkyl, alkenyl, alkynyl, phenyl or benzyl group. In another preferred embodiment of the invention, R8 and R9 represent, independently of one another, a linear or branched alkyl hydrocarbon-containing group, more preferentially a linear alkyl hydrocarbon-containing group.

In another preferred embodiment of the invention, R8 and R9 represent, independently of one another, a hydrocarbon-containing group optionally substituted by at least one oxygen, nitrogen, sulphur and/or phosphorus atom, preferably by at least one oxygen atom. In another preferred embodiment of the invention, R8 and R9 represent, independently of one another, a hydrocarbon-containing group comprising from 2 to 6 carbon atoms. In another preferred embodiment of the invention, R10 and R11 represent, independently of one another, a hydrocarbon-containing group comprising from 2 to 6 carbon atoms.

In another embodiment, the dithiophosphate is selected from the metal dithiophosphates of general formula (IV):

(IV)

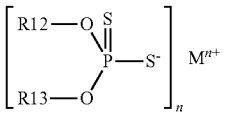

in which:

R12 represents a linear or branched, saturated or unsaturated, substituted or unsubstituted alkyl group comprising from 1 to 30 carbon atoms;

R13 represents a linear or branched, saturated or unsaturated, substituted or unsubstituted alkyl group comprising from 1 to 30 carbon atoms;

M represents a metal cation, preferably a $Zn^{2+}$ cation;

n represents the valency of the metal cation.

In a preferred embodiment of the invention, the metal is selected from the group constituted by zinc, aluminium, copper, iron, mercury, silver, cadmium, tin, lead, antimony, bismuth, thallium, chromium, molybdenum, cobalt, nickel, tungsten, sodium, calcium, magnesium, manganese and arsenic. The preferred metals are zinc, molybdenum, antimony, preferably zinc and molybdenum. In a preferred embodiment of the invention, the metal is zinc. Mixtures of metals can be used. The metal dithiophosphates are neutral, as exemplified in formula (IV), or basic when a stoichiometric excess of metal is present.

In a preferred embodiment of the invention, R12 and R13 represent, independently of one another, a hydrocarbon-containing group, optionally substituted, comprising from 2 to 24 carbon atoms, more preferentially from 3 to 18 carbon atoms, advantageously from 5 to 12 carbon atoms. In another preferred embodiment of the invention, R12 and R13 represent, independently of one another, an unsubstituted hydrocarbon-containing group, and said hydrocarbon-containing group can be an alkyl, alkenyl, alkynyl, phenyl or benzyl group. In another preferred embodiment of the invention, R12 and R13 represent, independently of one another, a linear or branched alkyl hydrocarbon-containing group, more preferentially a linear alkyl hydrocarbon-containing group. In another preferred embodiment of the invention, R12 and R13 represent, independently of one another, a hydrocarbon-containing group optionally substituted by at least one oxygen, nitrogen, sulphur and/or phosphorus atom, preferably by at least one oxygen atom.

Advantageously, the dithiophosphate according to the invention is a zinc dithiophosphate of formula (IV-a) or of formula (IV-b):

(IV-a)

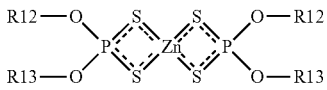

(IV-b)

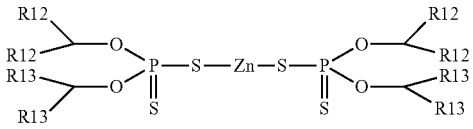

in which R12 and R13 are as defined above.

As metal dithiophosphate according to the invention, Additin® RC 3038, Additin® RC 3045, Additin® RC 3048, Additin® RC 3058, Additin® RC 3080, Additin® RC 3180, Additin® RC 3212, Additin® RC 3580, Kikulube® Z112, Lubrizol® 1371, Lubrizol® 1375, Lubrizol® 1395, Lubrizol® 5179, Oloa® 260, Oloa® 267 can for example be mentioned. In an embodiment of the invention, the content by weight of the compound comprising a dithiophosphate group ranges from 0.1 to 5%, preferentially from 0.2 to 4%, more preferentially from 0.5 to 2%, advantageously from 0.5 to 1.5% with respect to the total weight of the lubricant composition.

Base Oil

The lubricant compositions according to the invention can contain any type of lubricant base oil, mineral, synthetic or natural, animal or vegetable suited to their use. The base oil or oils used in the lubricant compositions according to the present invention can be oils of mineral or synthetic origin, of Groups I to V according to the classes defined in the API classification (or their equivalents according to the ATIEL classification) as summarized below, alone or in a mixture.

TABLE I

| | Saturates content | Sulphur content | Viscosity index (VI) |
|---|---|---|---|
| Group I Mineral oils | <90% | >0.03% | 80 ≤ VI < 120 |
| Group II Hydrocracked oils | ≥90% | ≤0.03% | 80 ≤ VI < 120 |
| Group III Hydrocracked or hydro-isomerized oils | ≥90% | ≤0.03% | ≥120 |
| Group IV | Poly Alpha Olefins (PAO) | | |
| Group V | Esters and other bases not included in bases of Groups I to IV | | |

The mineral base oils according to the invention include any type of bases obtained by atmospheric and vacuum distillation of crude oil, followed by refining operations such as solvent extraction, deasphalting, solvent dewaxing, hydrotreatment, hydrocracking and hydroisomerization, hydrofinishing. The base oils of the lubricant compositions according to the invention can also be synthetic oils, such as certain esters of carboxylic acids and alcohols, or poly alpha olefins. The poly alpha olefins used as base oils are obtained for example from monomers having from 4 to 32 carbon atoms (for example octene, decene), and have a viscosity at 100° C. between 1.5 and 15 cSt measured according to standard ASTM D445. Their weight-average molecular weight is typically between 250 and 3000 measured according to standard ASTM D5296. Mixtures of synthetic and mineral oils can also be used.

There is no limitation on the use of any particular lubricant base for producing the lubricant compositions according to the invention, except that they must have properties, in particular viscosity, viscosity index, sulphur content, oxidation resistance, suited to use in a gearbox, in particular in a motor vehicle gearbox, in particular in a manual gearbox. In an embodiment of the invention, the lubricant bases represent at least 50% by weight, with respect to the total weight of the lubricant composition, preferentially at least 60%, or also at least 70%. Typically, they represent between 75 and 99.9% by weight, with respect to the total weight of the lubricant compositions according to the invention.

The lubricant composition according to the invention has a kinematic viscosity at 100° C. measured according to standard ASTM D445 ranging from 4 to 50 cSt. In an embodiment, the kinematic viscosity at 100° C. measured according to standard ASTM D445 of the composition according to the invention ranges from 4 to 45 cSt, preferably from 4 to 30 cSt. In a preferred embodiment of the invention, the lubricant compositions comprise at least one base of Group IV. In another preferred embodiment of the invention, the lubricant compositions have a viscosity index (VI) greater than 95 (standard ASTM 2270).

Other Additives

The lubricant compositions according to the invention can also contain any type of additive suitable for use in the formulations of transmission oils, for example one or more additives selected from the polymers, the antioxidants, the anti-corrosion additives, the friction modifiers different from the metal nanoparticles according to the invention and the dispersants, present in the usual contents required for the application. In an embodiment of the invention, the additive is selected from dispersants having a weight-average molecular weight greater than or equal to 2000 Da. According to the invention, the weight-average molecular weight of the dispersant is assessed according to standard ASTM D5296. By dispersant within the meaning of the present invention, is meant more particularly any compound that improves the maintenance of the metal nanoparticles in suspension.

In an embodiment of the invention, the dispersant can be selected from the compounds comprising at least one succinimide group, the polyolefins, the olefin copolymers (OCP), the copolymers comprising at least one styrene unit, the polyacrylates or their derivatives. By derivatives, is meant any compound comprising at least one group or a polymer chain as defined above. Advantageously, the dispersant according to the invention is selected from the compounds comprising at least one succinimide group.

In a preferred embodiment of the invention, the dispersant is selected from the compounds comprising at least one substituted succinimide group or the compounds comprising at least two substituted succinimide groups, the succinimide groups being linked at their vertex bearing a nitrogen atom by a polyamine group. By substituted succinimide group within the meaning of the present invention, is meant a succinimide group at least one of the carbon-containing vertices of which is substituted by a hydrocarbon-containing group comprising from 8 to 400 carbon atoms. In a preferred embodiment of the invention, the dispersant is selected from the polyisobutylene succinimide-polyamines.

Advantageously, the dispersant according to the invention has a weight-average molecular weight ranging from 2000 to 15000 Da, preferably ranging from 2500 to 10000 Da, advantageously from 3000 to 7000 Da. Also advantageously, the dispersant has a number-average molecular weight greater than or equal to 1000 Da, preferably ranging from 1000 to 5000 Da, more preferentially from 1800 to 3500 Da, advantageously from 1800 to 3000 Da. According to the invention, the number-average molecular weight of the dispersant is assessed according to standard ASTM D5296. In a preferred embodiment of the invention, the content by weight of dispersant having a weight-average molecular weight greater than or equal to 2000 Da ranges from 0.1 to 10%, preferably from 0.1 to 5%, advantageously from 0.1 to 3% with respect to the total weight of the lubricant composition.

The polymers can be selected from the group of the shear-stable polymers, preferably from the group constituted by the ethylene and alpha-olefin copolymers, the polyacrylates such as polymethacrylates, the olefin copolymers (OCP), the ethylene propylene diene monomers (EPDM), the polybutenes, the copolymers of styrene and olefin, hydrogenated or not, or the copolymers of styrene and acrylate. The antioxidants can be selected from the amine-containing antioxidants, preferably the diphenylamines, in particular dialkylphenylamines, such as the octadiphenylamines, the phenyl-alpha-naphthyl amines, the phenolic antioxidants (dibutylhydroxytoluene BHT and derivatives) or sulphur-containing antioxidants (sulphurized phenates).

The friction modifiers can be compounds providing metallic elements that are different from the metal nanoparticles according to the invention, or an ash-free compound. Among the compounds providing metallic elements, the complexes of transition metals such as Mo, Sb, Sn, Fe, Cu, Zn, the ligands of which can be hydrocarbon-containing compounds containing oxygen, nitrogen, sulphur or phosphorus atoms, such as molybdenum dithiocarbamates or dithiophosphates, can be mentioned. The ash-free friction modifiers are of organic origin and can be selected from the monoesters of fatty acids and polyols, alkoxylated amines, alkoxylated fatty amines, amine phosphates, fatty alcohols, fatty epoxides, borated fatty epoxides, fatty amines or glycerol esters of fatty acid. By "fatty" is meant within the meaning of the present invention a hydrocarbon-containing group comprising from 8 to 24 carbon atoms.

The anti-corrosion additives can be selected from the phenol derivatives, in particular ethoxylated phenol derivatives and substituted by alkyl groups in the ortho position. The corrosion inhibitors can be dimercaptothiadiazole derivatives.

In an embodiment of the invention, the lubricant composition comprises:

from 75 to 99.89% of at least one base oil, from 0.01 to 2% of metal nanoparticles, from 0.1 to 5% of at least one compound comprising a dithiophosphate group.

In another embodiment of the invention, the lubricant composition essentially consists of:

75 to 99.89% of at least one base oil, 0.01 to 2% of metal nanoparticles, 0.1 to 5% of at least one compound comprising a dithiophosphate group.

All of the characteristics and preferences presented for the base oil, the metal nanoparticles and the compound comprising a dithiophosphate group also apply to the above lubricant compositions.

In an embodiment of the invention, the lubricant composition is not an emulsion. In another embodiment of the invention, the lubricant composition is anhydrous. The invention also relates to an engine oil comprising a lubricant composition according to the invention. The invention also relates to a transmission oil comprising a lubricant composition according to the invention. All of the characteristics and preferences presented for the lubricant composition also apply to the engine oil or transmission oil according to the invention.

The Parts

The lubricant composition according to the invention can lubricate at least one mechanical part or mechanical component, in particular bearings, gears, universal joints, transmissions, the pistons/rings/liners system, camshafts, clutch, manual or automatic gearboxes, axles, rocker arms, housings etc. In a preferred embodiment, the lubricant composition according to the invention can lubricate a mechanical part or a metal component of the transmission, clutch, axles, manual or automatic gearboxes, preferably manual. Thus, the invention also relates to the use of a lubricant composition as defined above for the lubrication of a mechanical part, preferably of a transmission component or of a vehicle engine, advantageously of motor vehicles.

The invention also relates to the use of a lubricant composition as defined above for reducing friction on the surface of a mechanical part, preferably of a transmission component or of a vehicle engine, advantageously of motor vehicles. The invention also relates to the use of a lubricant composition as defined above for reducing the fuel consumption of vehicles, in particular of motor vehicles. The invention also relates to the use of a lubricant composition as defined above for reducing the flaking of a mechanical part, preferably of a transmission component or of a vehicle engine, advantageously of motor vehicles. All of the characteristics and preferences presented for the lubricant composition also apply to the above uses.

The invention also relates to a process for the lubrication of a mechanical part, preferably of a transmission component or of a vehicle engine, advantageously of motor vehicles, said process comprising at least one step of bringing the mechanical part into contact with a lubricant composition as defined above. The invention also relates to a process for reducing the friction on the surface of a mechanical part, preferably of a transmission component or of a vehicle engine, advantageously of motor vehicles, comprising at least bringing the mechanical part into contact with a lubricant composition as defined above. The invention also relates to a process for reducing the fuel consumption of a vehicle, in particular of a motor vehicle comprising at least one step of bringing a mechanical part of the vehicle engine into contact with a lubricant composition as defined above. The invention also relates to a process for reducing the flaking of a mechanical part, preferably of a transmission component or of a vehicle engine, advantageously of motor vehicles, comprising at least bringing the mechanical part into contact with a lubricant composition as defined above. All of the characteristics and preferences presented for the lubricant composition also apply to the above processes.

The invention also relates to a composition of the additive-concentrate type comprising at least one compound comprising a dithiophosphate group and tungsten disulphide nanoparticles. All of the characteristics and preferences presented for the tungsten disulphide nanoparticles and the compound comprising a dithiophosphate group also apply to the above composition of the additive-concentrate type.

In an embodiment of the invention, at least one base oil can be added to the composition of the additive-concentrate type according to the invention, in order to obtain a lubricant composition according to the invention. All of the characteristics and preferences presented for the base oil also apply to the above embodiment.

The invention also relates to the use of a compound comprising a dithiophosphate group for decreasing the oxidation of a lubricant composition comprising at least one base oil and metal nanoparticles. All of the characteristics and preferences presented for the base oil, the metal nanoparticles and the compound comprising a dithiophosphate group also apply to the above use.

The different subjects of the present invention and their implementations will be better understood on reading the following examples. These examples are given as an indication, without being limitative in nature.

Examples

Lubricant compositions No. 1 to No. 4 were prepared from the following compounds:

a base oil of the PAO (poly alpha olefin) type of Grade 6 (viscosity at 100° C. in the region of 6 cSt measured according to standard ASTM D445), a mixture of tungsten disulphide nanoparticles at 20% of active ingredient in an oil (NanoLub Gear Oil Concentrate marketed by the company Nanomaterials), a compound comprising a dithiophosphate group: zinc dithiophosphate (Lz 1371 marketed by the company Lubrizol).

Lubricant compositions No. 1 to No. 4 are described in Table II; the percentages indicated are percentages by mass.

TABLE II

| | Lubricant composition | | | |
|---|---|---|---|---|
| | No. 1 | No. 2 | No. 3 | No. 4 |
| Base oil | 100 | 99 | 99 | 98 |
| Compound comprising a dithiophosphate group | | 1 | | 1 |
| Tungsten disulphide nanoparticles (NanoLub Gear Oil Concentrate) | | | 1 | 1 |

Test 1: Assessment of the Friction Properties of Lubricant Compositions

It is a question of assessing the friction properties of lubricant compositions No. 1 to No. 4 by measuring the coefficient of friction. The coefficient of friction is assessed using a pin-on-plate linear tribometer under the following conditions:

type of steel: AISI 52100 (hardness=800 HV),
roughness of the plate: 35 nm,
temperature: 100° C.,
calculated contact pressure: 1.12 GPa,
sliding speed: 3 mm/s
humidity level: 35-45R (ambient atmosphere),
test duration: 8 h.

Table III gives the average coefficient of friction of lubricant compositions No. 1 to No. 4; the average coefficient of friction represents the average of the values of the coefficient of friction obtained after 4 tests.

TABLE III

| | Composition | | | |
|---|---|---|---|---|
| | No. 1 | No. 2 | No. 3 | No. 4 |
| Coefficient of friction | 0.100 | 0.110 | 0.075 | 0.060 |

These results show that the lubricant composition according to the invention No. 4 has improved friction properties, with respect to a lubricant composition comprising a compound comprising a dithiophosphate group according to the invention but not comprising metal nanoparticles (composition No. 2) and with respect to a composition comprising metal nanoparticles according to the invention but not comprising a compound comprising a dithiophosphate group (composition No. 3). These results thus show a synergy of activity of the combination of a compound comprising a dithiophosphate group and metal nanoparticles in a lubricant composition for significantly reducing the coefficient of friction, in particular for steel/steel contacts. These results also show that the effectiveness of friction reduction is maintained over time by using a lubricant composition according to the invention. Moreover, lubricant composition No. 4 has satisfactory stability.

The invention claimed is:

1. A lubricant composition comprising a kinematic viscosity at 100° C. measured according to standard ASTM D445 ranging from 4 to 50 cSt and further comprising:

at least 70 wt. % of at least one base oil, from 0.5 to 2 wt. % of at least one compound comprising a dithiophosphate group, the at least one compound comprising the dithiophosphate group comprising a zinc dithiophosphate, and from 0.1 to 2 wt. % metal nanoparticles, the metal nanoparticles having an average size ranging from 50 to 200 nm and being concentric polyhedrons with a multilayer or sheet structure, wherein the metal nanoparticles are selected from the group consisting of $MoS_2$, $MoSe_2$, $MoTe_2$, $WS_2$, $WSe_2$, $ZrS_2$, $ZrSe_2$, $HfS_2$, $HfSe_2$, $PtS_2$, $ReS_2$, $ReSe_2$, $TiS_3$, $ZrS_3$, $ZrSe_3$, $HfS_3$, $HfSe_3$, $TiS_2$, $TaS_2$, $TaSe_2$, $NbS_2$, $NbSe_2$, and $NbTe_2$ and wherein the metal nanoparticles are maintained as a suspension within the at least one base oil and the at least one compound comprising the dithiophosphate group.

2. The lubricant composition according to claim 1, wherein the at least one compound comprising a dithiophosphate group further comprises an ammonium dithiophosphate, an amine dithiophosphate, an ester dithiophosphate, or combinations thereof.

3. The lubricant composition according to claim 1, wherein the at least one compound comprising the dithiophosphate group further comprises a compound of formula (IV)

(IV)

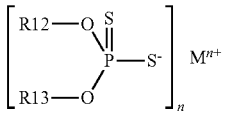

wherein:

R12 represents a linear or branched, saturated or unsaturated, substituted or unsubstituted alkyl group comprising from 1 to 30 carbon atoms;

R13 represents a linear or branched, saturated or unsaturated, substituted or unsubstituted alkyl group comprising from 1 to 30 carbon atoms;

M represents a metal cation; and n represents the valency of the metal cation.

4. The lubricant composition according to claim 1, wherein the zinc dithiophosphate is a compound of formula (IV-a) or of formula (IV-b):

(IV-a)

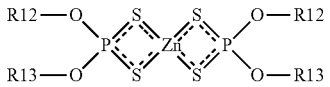

(IV-b)

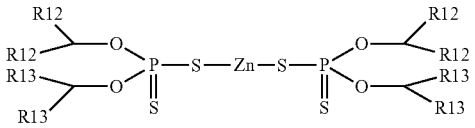

wherein:

R12 represents a linear or branched, saturated or unsaturated, substituted or unsubstituted alkyl group comprising from 1 to 30 carbon atoms;

R13 represents a linear or branched, saturated or unsaturated, substituted or unsubstituted alkyl group comprising from 1 to 30 carbon atoms.

5. The lubricant composition according to claim 1, further comprising an additive selected from: polymers, antioxidants, anti-corrosion additives, friction modifiers different from the metal nanoparticles, and dispersants.

6. A method for lubricating a mechanical part, comprising bringing the mechanical part into contact with a lubricant composition comprising:

at least one base oil, at least one compound comprising a dithiophosphate group at a content of from 0.5 to 2% with respect to a total weight of the lubricant composition, the at least one compound comprising the dithiophosphate group comprising a metal dithiophosphate, and metal nanoparticles at a content by weight ranging from 0.1 to 2% with respect to a total weight of the lubricant composition, the metal nanoparticles having an average size ranging from 50 to 200 nm and being concentric polyhedrons with a multilayer or sheet structure, wherein the metal nanoparticles are selected from the group consisting of $MoS_2$, $MoSe_2$, $MoTe_2$, $WS_2$, $WSe_2$, $ZrS_2$, $ZrSe_2$, $HfS_2$, $HfSe_2$, $PtS_2$, $ReS_2$, $ReSe_2$, $TiS_3$, $ZrS_3$, $ZrSe_3$, $HfS_3$, $HfSe_3$, $TiS_2$, $TaS_2$, $TaSe_2$, $NbS_2$, $NbSe_2$, and $NbTe_2$, wherein the composition has a kinematic viscosity at 100° C. measured according to standard ASTM D445 ranging from 4 to 50 cSt, and wherein the lubricant composition lubricates the mechanical part.

7. The method according to claim 6, wherein the mechanical part is a mechanical part of motor vehicles.

8. A method for reducing the fuel consumption of vehicles, comprising bringing a mechanical part of a vehicle engine into contact with a lubricant composition comprising at least one base oil, from 0.5 to 2 wt. % of at least one compound comprising a metal dithiophosphate group, and metal nanoparticles at a content by weight ranging from 0.1 to 2% with respect to a total weight of the lubricant composition, the metal nanoparticles being selected from the group consisting of $MoS_2$, $MoSe_2$, $MoTe_2$, $WS_2$, $WSe_2$, $ZrS_2$, $ZrSe_2$, $HfS_2$, $HfSe_2$, $PtS_2$, $ReS_2$, $ReSe_2$, $TiS_3$, $ZrS_3$, $ZrSe_3$, $HfS_3$, $HfSe_3$, $TiS_2$, $TaS_2$, $TaSe_2$, $NbS_2$, $NbSe_2$, and $NbTe_2$ and having an average size ranging from 50 to 200 nm and being concentric polyhedrons with a multilayer or sheet structure, the composition having a kinematic viscosity at 100° C. measured according to standard ASTM D445 ranging from 4 to 50 cSt, wherein the lubricant composition lubricates the mechanical part, and reducing the fuel consumption of the vehicles with the lubricant composition.

9. The lubricant composition according to claim 1, wherein the zinc dithiophosphate is present at a concentration of about 1 wt. %, and the metal nanoparticles are tungsten disulphide nanoparticles at a concentration of about 1 wt. %.

10. The lubricant composition according to claim 1, wherein the at least one base oil comprises a poly alpha olefin-type base oil.

11. The lubricant composition according to claim 1, comprising 98 wt. % of the at least one base oil, 1 wt. % of the zinc dithiophosphate group, and 1 wt. % of the metal nanoparticles.

12. The lubricant composition according to claim 11, wherein the metal nanoparticles comprise tungsten disulphide.

13. The lubricant composition according to claim 1, wherein the zinc dithiophosphate comprises Lubrizol® 1371 zinc dithiophosphate.

* * * * *